United States Patent [19]

Daussan

[11] 4,096,976

[45] Jun. 27, 1978

[54] VESSELS FOR TRANSFERRING LIQUID METAL HAVING A REMOVABLE INSULATING LINING

[75] Inventor: Henri Jean Daussan, Longeville-les Metz, France

[73] Assignee: Daussan et Compagnie, Metz, France

[21] Appl. No.: 697,633

[22] Filed: Jun. 18, 1976

[30] Foreign Application Priority Data

Jun. 30, 1975 Luxembourg ..... 72865

[51] Int. Cl.[2] ..... B22D 41/02

[52] U.S. Cl. ..... 222/591; 222/600; 222/607; 266/281

[58] Field of Search ..... 222/590, 591, 606, 607, 222/600; 164/335, 337; 266/280, 281

[56] References Cited

U.S. PATENT DOCUMENTS

| | | | |
|---|---|---|---|
| 3,801,083 | 4/1974 | Mantey et al. | 222/591 X |
| 3,955,721 | 5/1976 | LaBate | 222/607 |
| 4,012,029 | 3/1977 | Sequin et al. | 222/607 X |
| 4,022,358 | 5/1977 | Courtenay | 222/607 |

FOREIGN PATENT DOCUMENTS

| | | | |
|---|---|---|---|
| 1,124,191 | 11/1955 | Germany | 222/591 |
| 932,073 | 7/1963 | United Kingdom | 222/591 |
| 1,196,993 | 7/1970 | United Kingdom | 222/591 |

OTHER PUBLICATIONS

"New Liner for Tundish Developed by Foseeo": American Metal Market; 7/21/70, page 1.

*Primary Examiner*—Robert B. Reeves
*Assistant Examiner*—David A. Scherbel
*Attorney, Agent, or Firm*—Young & Thompson

[57] ABSTRACT

The permanent refractory lining of a liquid metal transfer vessel is covered with a removable heat-insulation lining formed of inorganic particles embedded in a binder, the particles being sinterable at the temperature of the liquid metal to be introduced into the vessel. The liquid metal is thus prevented from coming into contact with the permanent lining and any danger of solidification of metal and damage to this latter is consequently removed.

5 Claims, 13 Drawing Figures

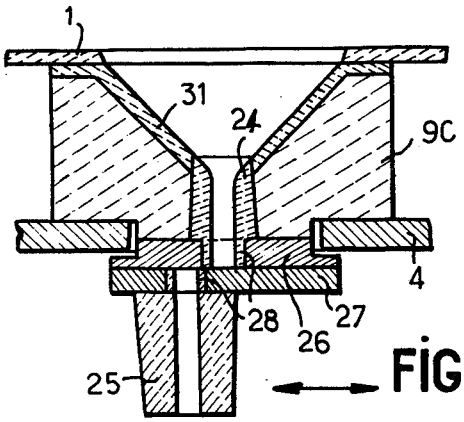
FIG.10
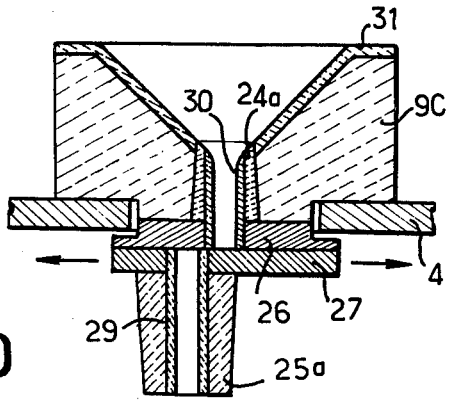
FIG.11
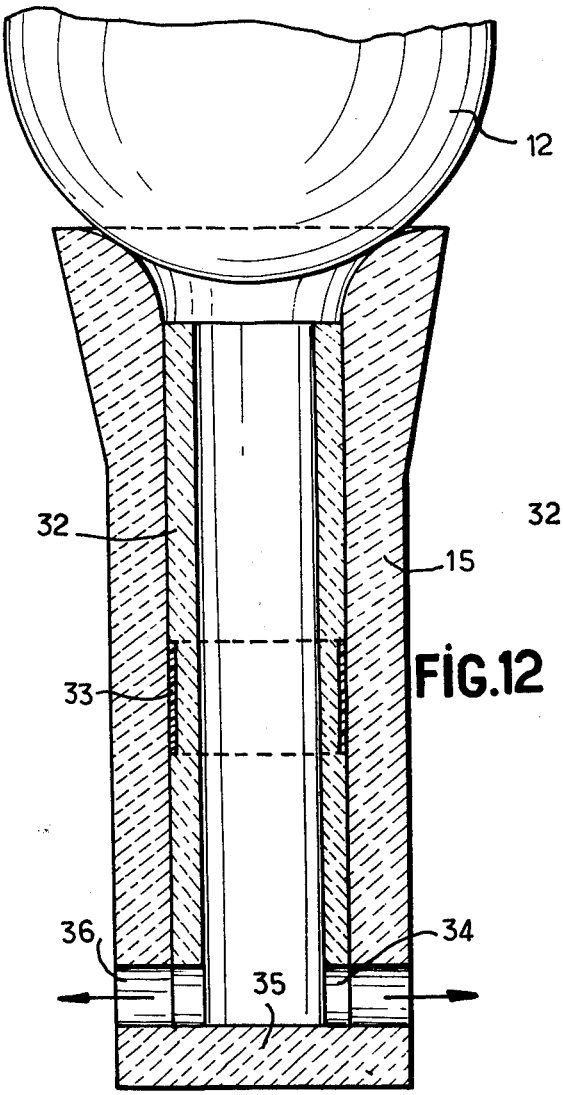
FIG.12
FIG.13
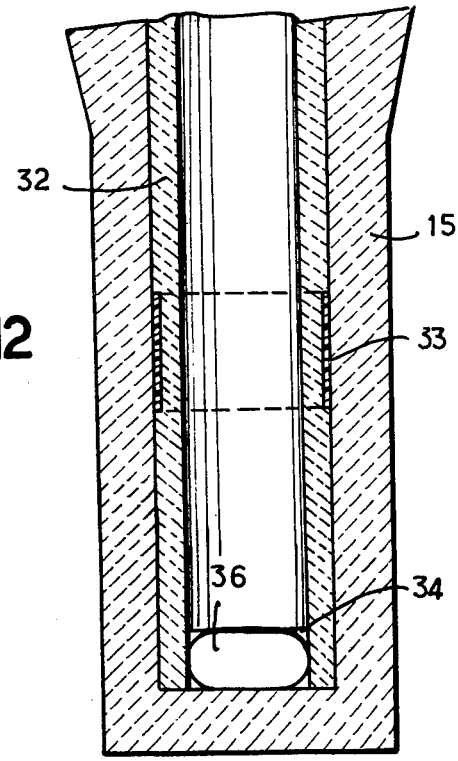

VESSELS FOR TRANSFERRING LIQUID METAL HAVING A REMOVABLE INSULATING LINING

This invention relates to vessels for transferring liquid metal and especially the vessels known as tundishes. The invention also applies to all transfer vessels such as runners, casting ladles and slag ladles. A primary objective of the invention is to improve the properties of refractory linings of the vessels aforesaid.

Vessels for transferring liquid metal as mentioned above are usually lined with chamotte of silica, dolomite, magnesia, chrome-magnesia or light insulating material (refractory particles embedded in an organic or inorganic binder).

Linings of this type are both inconvenient and costly to use. In fact, they entail the need for preheating for a considerable length of time (of the order of 4 to 7 hours), the temperature of the molten metal in these linings is not constant and they are liable to give rise to non-metallic inclusions in the metal at the time of casting. Furthermore, such linings call for the use of an oxygen blowtorch in order to remove the residues known as "bears" from the bottom of the vessels. This operation is both costly and complicated.

Vessels provided with linings of light insulating material of the types which are known at the present time are attended by practically the same disadvantages as vessels lined with ordinary refractory materials. In fact, since the discharge holes of these vessels are made up of a nozzle seating and of a nozzle which is usually of pure alumina and/or zirconia which are incorporated in the transfer vessel, they entail the need for preheating over a long period of time. This has the effect of destroying the lining of heat-insulating material before the liquid metal to be transferred has been introduced into the vessel. In vessels of this type, it is also advisable to carry out complete dehydration of the mortar which maintains said nozzle seating in position within the transfer vessel. Moreover, this arrangement of nozzle seating and nozzle has a further disadvantage in that these latter adhere strongly to the metal both during and at the end of the casting operation. This makes it difficult to extract the residues from the bottom of vessels and causes at least partial destruction of the protective refractory lining of the transfer vessel.

The aim of the present invention is to overcome the disadvantages of the designs mentioned in the foregoing by providing a transfer vessel having an internal lining which permits an appreciable reduction in potential hazards of solidification of metal and damage to the permanent refractory lining, said transfer vessel having a further advantage in that it can be very readily cleaned on completion of the casting operation.

In accordance with the invention, the liquid metal transfer vessel provided with a permanent lining of refractory material is distinguished by the fact that the permanent lining is covered with a removable heat-insulation lining formed of inorganic particles embedded in a binder, said inorganic particles being sinterable at the temperature of the liquid metal which is intended to be introduced into the transfer vessel. Said lining provides the transfer vessel with highly effective heat insulation and makes it possible to prevent any contact between the liquid metal and the subjacent permanent refractory lining which would otherwise be liable to result in solidifications of metal and in damage to said permanent lining.

Furthermore, since the heat-insulation lining is removable or in other words simply placed on the permanent lining, the heat-insulation lining is detached from the walls of the vessel simply by turning this latter upside down. Thus the residues of the casting operation which are present at the bottom of the vessel are removed directly by means of this single operation.

In accordance with one advantageous embodiment of the invention, the heat-insulation lining is sinterable in contact with the liquid metal introduced into the transfer vessel. In contact with the liquid metal, the inorganic particles of the heat-insulation lining are welded to each other so as to form a sintered or vitrified surface layer which prevents complete destruction of the heat-insulation lining.

By way of alternative, the heat-insulation lining can be constituted by plates which are sintered prior to introduction of the liquid metal into the transfer vessel by subjecting these latter to heating to a temperature which is comparable with that of the liquid metal to be introduced into the transfer vessel.

In a preferred embodiment of the invention, the vessel pouring holes are also fitted with a detachable internal lining of insulating material which is sinterable in contact with the liquid metal or which has previously been sintered.

This accordingly forestalls any danger of solidification of the metal at the level of the pouring holes or of the pouring nozzles which would be liable to clog these latter. This lining which covers the internal surface of the pouring holes is detachable in the same manner as the heat-insulation lining aforementioned simply by turning the transfer vessel upside down.

Further particular features and advantages of the invention will become apparent from the following description, reference being made to the accompanying drawings which are given by way of example without any limitation being implied, and in which:

FIGS. 10 and 11 are alternative designs of pouring holes relating to so-called slide-valve nozzle closures;

FIG. 12 is a sectional view to a large scale showing an immersion nozzle as well as a portion of the lower end of the stopper rod;

FIG. 13 is a cutaway side view of FIG. 12 showing the upper portion of the immersion nozzle.

Figure 1:
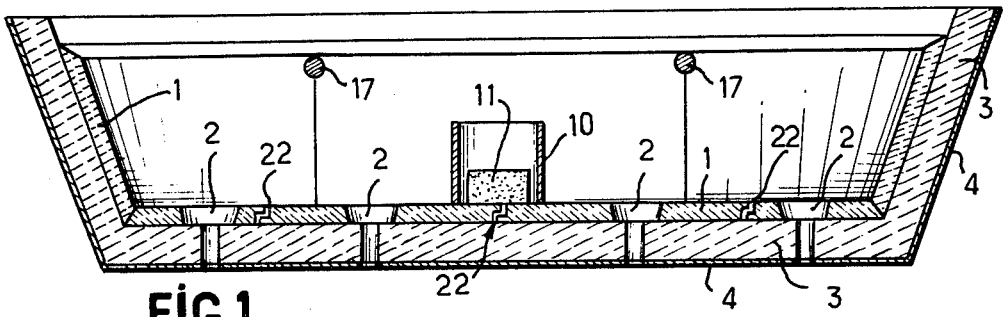
FIG. 1 is a longitudinal sectional view of a transfer vessel.
Figure 2:
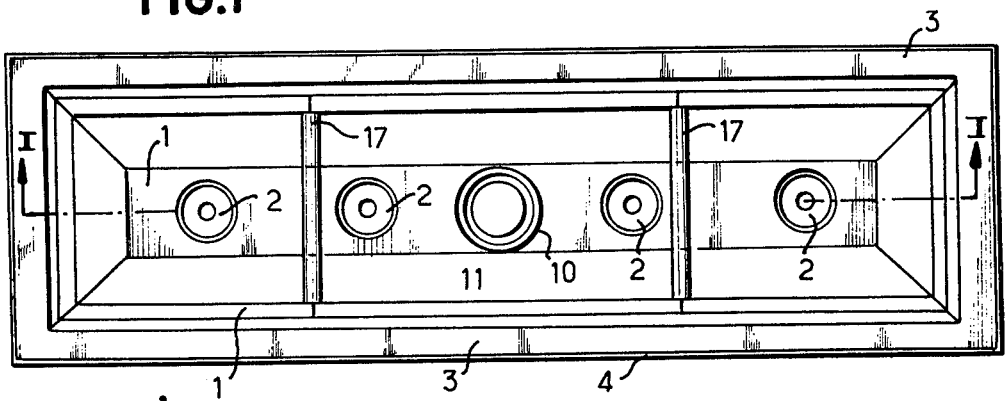
FIG. 2 is a top view of the vessel shown in FIG. 1.

The transfer vessel in accordance with the invention comprises, as shown in FIGS. 1 and 2, an internal lining 1 constituted by lightweight insulating plates which are sinterable or have previously been sintered and have a thickness which can vary from 10 mm to 100 mm. Said plates 1 are placed within the transfer vessel, directly in contact with the refractory bricks 3 of the permanent lining without any sand bed between these latter and the plates 1. Said plates can be assembled either by clamping a certain number of plates 1 which perform a wedge function or simply by nailing or bracing by means of stay-rods 17 or any like means.

Sintering of the lining 1 is obtained either by a judicious choice of size of the inorganic particles which constitute the lining or by adding a flux so as to ensure that sintering takes place in the vicinity of 1000° to 1300° C. Its composition is that of linings of conventional insulating material, that is: refractory charge, mineral and/or vegetable fibers, organic and/or inorganic binders, the density being within the range of 0.4 to 1.2. The lining 1 can extend to a smaller height than that of the transfer vessel in order to reduce its cost price.

The composition of the heat-insulation lining which constitutes the plates 1 is given below by way of example:

refractory inorganic particles such as, for example, silica and/or alumina and/or magnesium oxide: 50 to 95% by weight, organic and/or inorganic binder such as, for example, phenol-formaldehyde resin, sodium silicate, silica sol, alumina sol or refractory cement: 0.5 to 20% by weight.

This composition can also contain mineral and/or organic fibers such as asbestos, slag wool in a proportion of 3 to 40% by weight of the total weight of the composition.

These fibers make it possible to increase the cohesion of the heat-insulation lining 1, in particular before they are placed within the vessel. In the case of mineral fibers, these latter can also take part in the formation of the sintered or vitrified surface layer.

The composition mentioned above can also contain fluxes such as, for example, metal oxides such as oxides of alkali metals having a melting point which is chosen so as to reduce the temperature of formation of the sintered or vitrified surface layer of the lining 1. It is thus possible to adjust the sintering temperature of the surface layer to a temperature within the range of approximately 1000° to 1400° C.

In order to obtain a continuous sintered surface layer, it is important to ensure that the inorganic particles of the lining 1 are distributed as uniformly as possible within said lining and are relatively close to each other. To this end, the inorganic particles should be as small as possible. p At the sintering temperature, the organic or inorganic binder of the heat-insulation lining 1 decomposes and becomes powdery. This powdery layer formed between the permanent refractory lining 3 and the sintered surface layer of the lining 1 serves to maintain heat insulation of the lining 1 throughout the period of residence of the liquid metal within the transfer vessel.

Moreover, the lining 1 does not adhere to the permanent refractory lining 3.

The pouring holes for the discharge of liquid metal are shown at 2.

Figure 3:
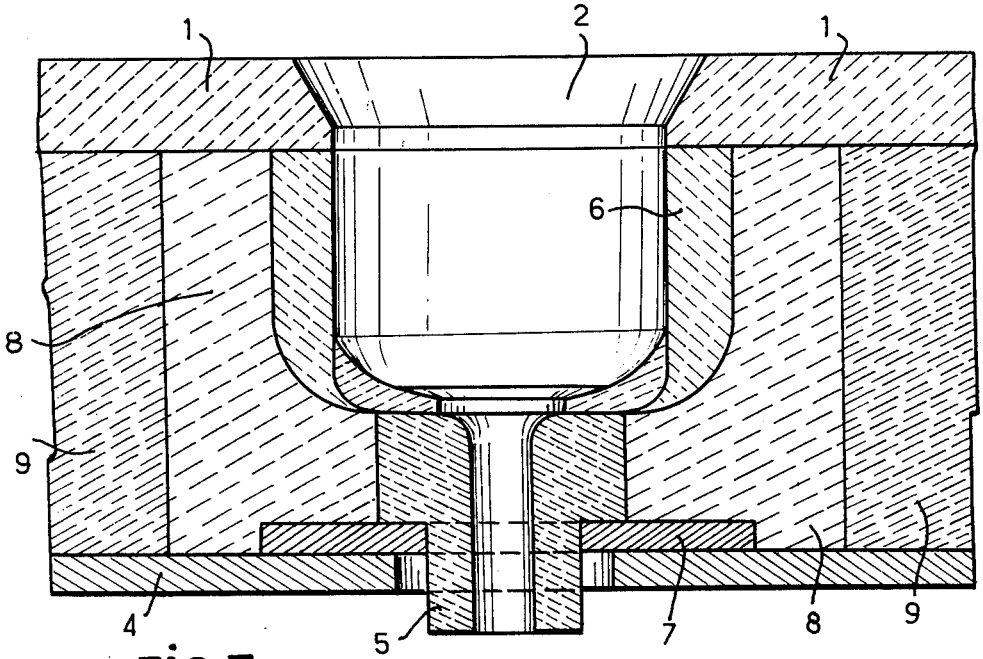
FIG. 3 is a sectional view to a larger scale at the level of a pouring hole of the vessel shown in FIG. 1.

FIG. 3 is an enlarged detail view of a pouring hole 2 and shows the position of the nozzle 5 which is constructed in a single piece in this example or in other words is both a nozzle and a nozzle seating at the same time. It is only necessary to preheat the nozzle for a period of about two hours before introducing the liquid metal into the vessel.

This type of nozzle is more especially employed in the case of tundishes in which no provision is made either for a stopper rod or for a nozzle of the slide-valve type. When it is desired to stop the casting operation, the usual practice consists in throwing copper balls which come to rest within the pot 6 and obstruct the nozzle 5. The nozzle 5 is seated on a metallic annular collar 7 which is in turn placed on the metallic mantle 4 of the transfer vessel. The nozzle 5 is usually of highly refractory material. Said nozzle is surmounted by a pot 6 of lightweight insulating material which is sinterable or has previously been sintered and is of the same nature as the material of the plates 1. The nozzle 5 and the pot 6 are maintained in position by means of a mortar 8 which is inserted between the pot 6 and the nozzle 5 and by means of the refractory ring 9 which is adjacent to the pouring hole 2.

The plate 1 of the lining is provided at 2 with a metal discharge orifice which covers the pot 6 of light insulating material, thus preventing it from floating on the surface when the vessel is filled with liquid metal.

In FIG. 1, there is shown at 10 a small vessel which is placed on the bottom of the transfer vessel. A block 11 which may or may not form part of the lining 1 and is intended to receive the impact of the jet of liquid metal is placed inside the small vessel 10. The design function of said small vessel is on the one hand to prevent splashing of the jet of metal and on the other hand to serve as an intermediate vessel for accumulating a certain quantity of liquid metal before this latter reaches the pouring holes 2. This arrangement makes it possible to prevent cooling of the first fraction of liquid metal introduced into the transfer vessel and to prevent this latter from solidifying at the level of the pouring holes 2.

The block 11 can be an overthickness of the plate 1 of sinterable or previously sintered material which is located beneath the small vessel 10. Said block 11 can also be of material which affords high resistance to the erosion produced by the jet of liquid metal, for example a refractory material having a base of alumina or of magnesium oxide.

When the transfer vessel is turned upside down on completion of the casting operation, the result thereby achieved is that the metal which may have solidified in contact with the lining 1 of the pot 6 or of the nozzle 5 does not have any power of adhesion either to the external metallic mantle 4 of the vessel or to the permanent refractory lining 3. Without any other operation, the lining 1 and the entire discharge outlet system 2 are removed simply by turning the transfer vessel upside down. The permanent refractory lining 3 has remained intact and is ready to receive another sintered or sinterable lining 1 for the following casting operation. It is noted in particular from FIG. 3 that the mortar 8 does not have any possible contact with the liquid metal, with the result that no useful purpose is served by drying said mortar for any length of time prior to the casting operation. In consequence, there is a substantial saving of power and no danger of introduction of gas and non-metallic particles into the liquid metal contained in the transfer vessel.

Figure 4:
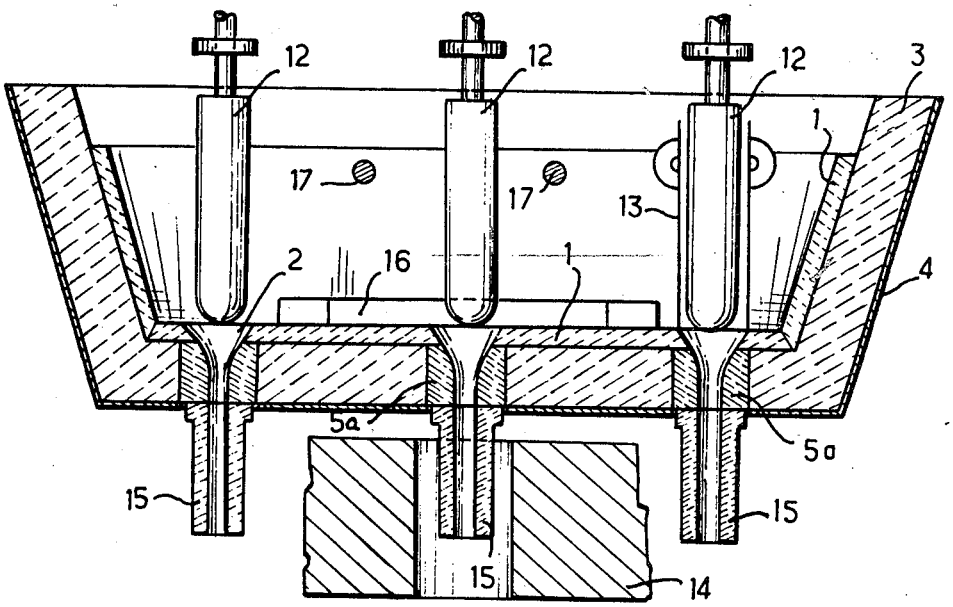
FIG. 4 is a longitudinal sectional views of an alternative embodiment of the transfer vessel shown in FIG. 1, comprising stopper rods for closing the pouring holes.
Figure 5:
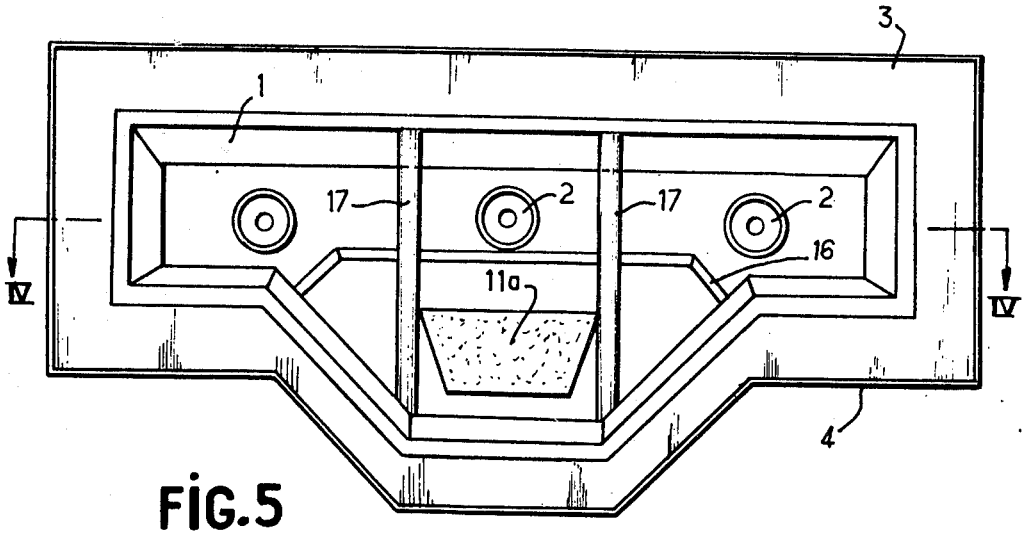
FIG. 5 is a top view of the vessel shown in FIG. 4, the stopper rods having been removed.

FIGS. 4 and 5 relate to a tundish provided with stopper rods 12 which are placed above the pouring holes 2.

This type of tundish is usually employed for continuous casting operations on a larger scale than in the case of the embodiment shown in FIGS. 1 and 2. This type of vessel calls for a longer preheating time on account of the presence of the stopper rods 12.

In FIG. 4, one of the stopper rods 12 is surrounded by a shielding pipe or two shielding half-pipes 13, the lower end of which surrounds the pouring hole 2. Said shielding pipe or two half-pipes 13 serve to orient and to direct the burner flames for preheating the stopper rod 12 and the nozzles 15.

It is also possible to preheat the nozzles 15 by introducing these latter within a small furnace 14 (as shown in FIG. 4).

The reference numeral 16 designates a weir which can have a height of 30 mm. Said weir is placed upstream of the pouring holes 2 and is constituted by bars of heat-insulation material which is identical with the material of the lining 1, said bars being secured at the bottom of the vessel.

The weir 16 is intended to accumulate a certain quantity of liquid metal at the beginning of introduction of this latter into the vessel in order to ensure that said metal is hot when it reaches the pouring holes 2 and to prevent any danger of clogging of the nozzles 15 with solidified metal.

In the embodiment of FIG. 5, there is also shown a plate 11*a* of refractory material which is placed in the zone of impact of the jet of liquid metal.

Figure 6:
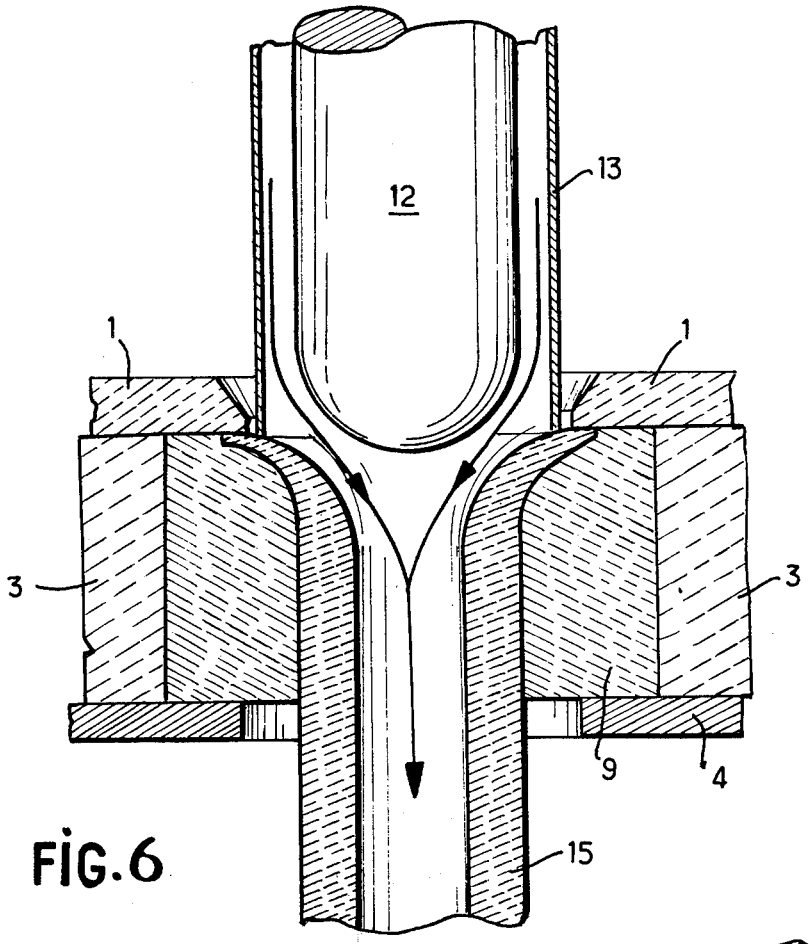
FIG. 6 is a sectional view to a large scale at the level of the pouring hole of a transfer vessel.

FIG. 6 is an enlarged sectional view at the level of a pouring hole 2 of FIG. 4. The mode of assembly of the nozzle 15 is slightly different from that of FIG. 3. There is first placed in position a ring 9 on which the nozzle 15 is intended to bear. The plates 1 have the effect of securing the complete assembly in rigidly fixed relation. In order to replace the lining 1 on completion of the casting operation, the procedure is the same as in the previous case, the vessel being accordingly turned upside down after the stopper rods 12 have been removed.

At the time of reversal of the transfer vessel, the plates 1 of the heat-insulation lining as well as the nozzles 15 become detached from the vessel of their own accord and fall onto the ground. Any solid residues which may have adhered to the bottom of the vessel or at the level of the pouring holes 2 are thus removed without any other operation.

A further advantage of the invention lies in the fact that, by virtue of the heat-insulation lining 1, the transfer vessel or tundish does not need to be fitted with a lid or cover. In fact, in known designs, it had been found necessary to employ a metal cover of very large size, said cover being lined with refractory bricks with a view to preheating both the vessel and the cover to redness. A further purpose of this cover was to prevent oxidation of the surface of the melt during a casting operation which can sometimes lasts a few hours.

By virtue of the heat-insulation lining 1 which no longer requires preheating over its entire surface, it is possible to dispense with the cover and with total preheating. Nevertheless, in order to prevent oxidation of the surface of the melt, it may prove advantageous to place on said surface either plates of the same type as the lining 1 or to spread over the surface of the liquid metal either a powder formed of ground plates of light insulating material or an insulating powder formed of vegetable waste matter which has previously been carbonized.

Figure 7:
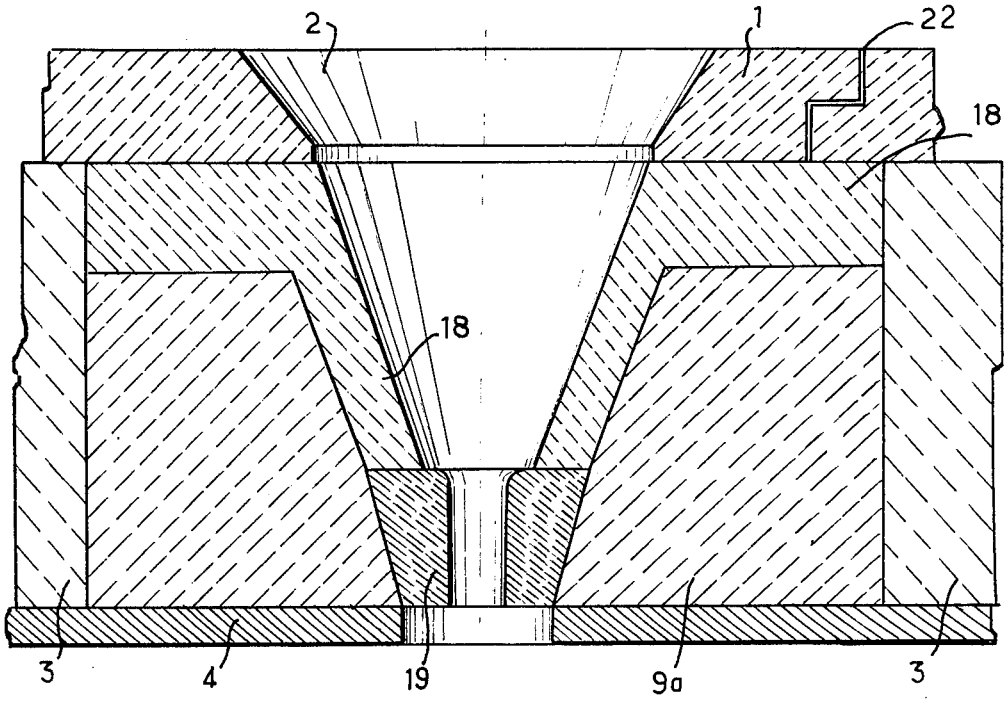
FIGS. 7 and 8 are views which are similar to FIG. 6 and relate to alternative embodiments of pouring holes.

In the embodiment of FIG. 7, the pouring hole 2 is fitted internally with a discharge pot 18 fabricated from the same material as the plates 1. The lower portion of said discharge pot 18 is of frusto-conical shape and the upper portion has an annular flange which is inserted between the heat-insulation lining 1 and the refractory brick 9*a* which forms a complementary cavity, said refractory brick being placed on the metallic mantle 4 in adjacent relation to the permanent refractory lining 3.

The base of the discharge pot 18 rests on the nozzle 19 of refractory material which is in turn removably engaged within the frusto-conical cavity of the refractory brick 9*a*. This arrangement offers the following advantages:

a considerable reduction in the time of preheating of the nozzle 19, the height of this latter being distinctly smaller than the total thickness of the bottom of the vessel;

the possibility of level adjustment between the refractory brick 9*a* and the plates 1 of the bottom of the vessel;

the mortar 8 shown in FIG. 3 need no longer be employed;

the prevention of wear and sometimes replacement of the refractory brick 9*a* after each casting operation;

the service life of the refractory brick 9*a* is increased to over 20 casting operations.

Figure 8:
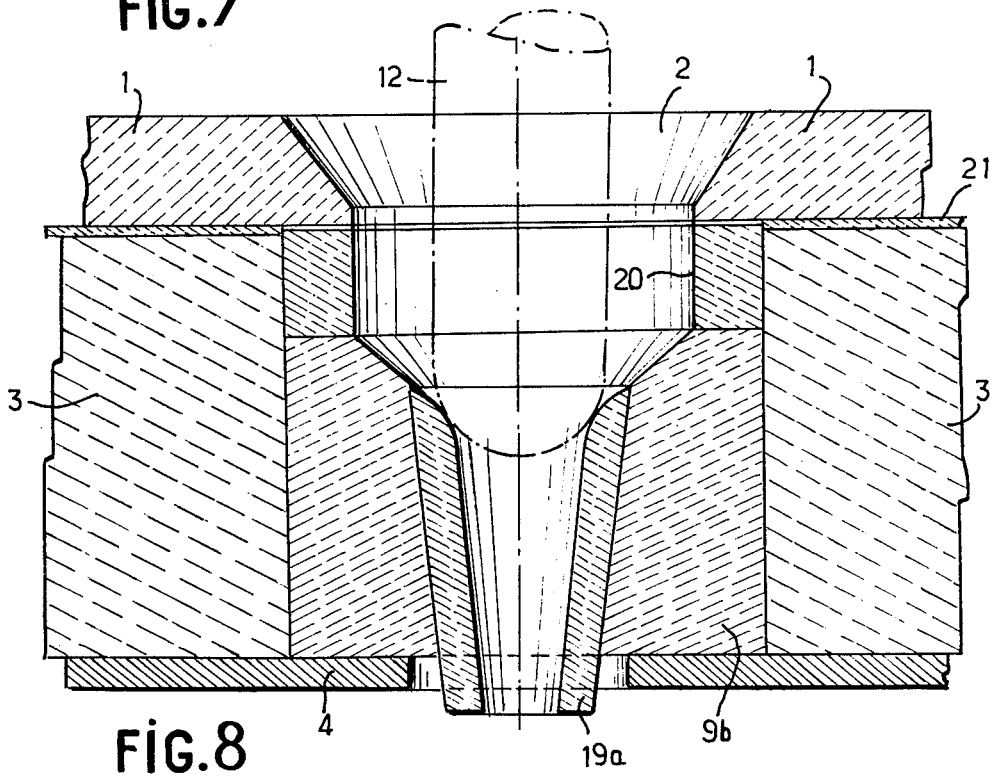

FIG. 8 relates to an alternative form of the embodiments shown in FIGS. 3 and 7. In this example, the pouring hole 2 comprises a ring 20 which is formed of the same material as the discharge pot 18 of FIG. 7. This ring 20 is inserted between the heat-insulation lining 1 and the refractory brick 9*b* which is placed on the metallic mantle 4 in adjacent relation to the permanent refractory lining 3.

The advantages of this arrangement are as follows:

heat insulation is improved to a maximum extent in the liquid metal discharge zone by covering as much as possible with sinterable or sintered insulating material the adjacent surfaces of the permanent lining 3 and of the refractory brick 9*b* which are located above the nozzle 19*a;* level adjustment is permitted between the refractory brick 9*b* and the plates 1 of the bottom of the vessel;

the space 21 between the permanent lining 3 and the plates 1 of the bottom of the transfer vessel can either be provided or dispensed with.

It proves advantageous in some cases to fill the space 21 with a powdered product of any desired type since the steel is not in contact with this latter. This method is adopted especially when the surface of the permanent lining 3 is irregular and does not permit a strictly flat contact between the permanent lining 3 and the plates 1.

At the time of reversal of the transfer vessel, the plates 1 as well as the ring 20, the refractory brick 9*b* and the nozzle 19*a* fall to the ground of their own accord as in the previous embodiments, with the result that the casting residues are directly removed.

It is also seen in the embodiments shown in FIGS. 1 and 7 that the plates 1 constituting the heat-insulation lining of sinterable or previously sintered material have adjacent edges 22 in overlapping relation. This arrangement makes it possible to take up any play which may exist between the adjacent edges of the plates 1 and thus to prevent any contact between the liquid metal and the permanent lining 3 of refractory bricks.

Figure 9:
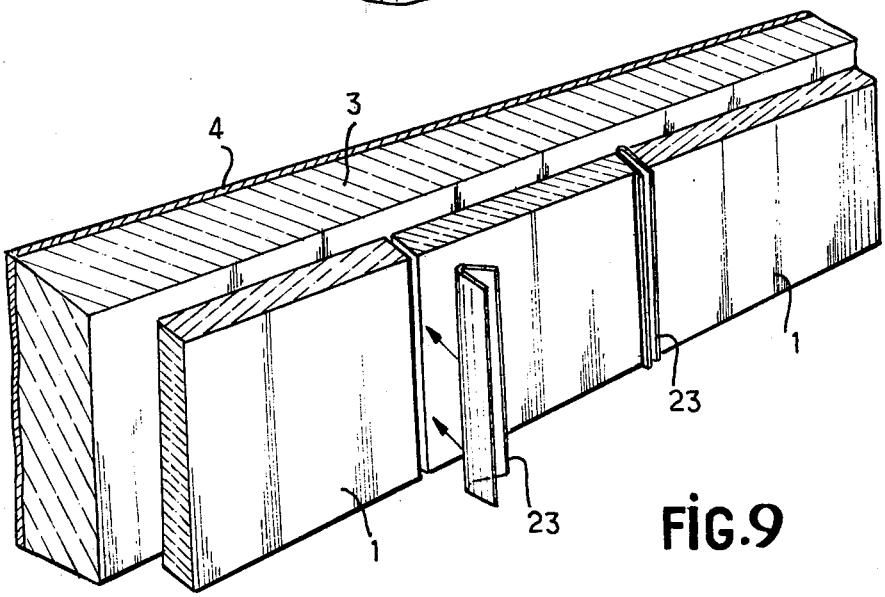
FIG. 9 is a partial view in perspective and in section showing an alternative design of the lining of a transfer vessel.

In the embodiment shown in FIG. 9, the plates 1 of the heat-insulation lining are separated by resilient strips 23, for example of steel and having a substantially V-shaped transverse cross-section. These resilient strips 23 are driven in by means of a hammer between the adjacent edges of the plates, thus having the effect of tightly applying the plates 1 against each other and of ensuring excellent leaktightness with respect to the liquid metal.

Said resilient strips 23 serve to take up existing play between the adjacent edges of the plates 1 and dispense with the need for sealing compounds or special refractory cement for jointing the plates 1 which has the disadvantage of giving rise to intense bubbling of the metal and of introducing harmful gases into this latter. By way of example, the resilient strips 23 can be fabricated from a steel sheet having a thickness within the range of approximately 0.3 mm to 2 mm, for example.

FIG. 10 relates to another alternative form of embodiments shown in FIGS. 3, 6, 7 and 8. In this example, the pouring hole is designated as a slide-valve nozzle closure. This assembly comprises a heat-insulating discharge pot 31 which covers the nozzle seating 9*c* of refractory brick.

Said pot 31 is inserted between the heat-insulation lining 1 and the refractory brick 9*c* which is placed on the metallic mantle 4. The metal plate 26 supports the stationary upper refractory nozzle 24. Said plate 26 is removable and is designated as the bottom plate of the metallic mantle 4. The plate 27 which is placed beneath the plate 26 is slidably mounted and supports the lower refractory and sliding nozzle 25. The plate 27 and the nozzle 25 are capable of sliding from left to right and conversely within guides (not shown) relatively to the plate 26 and to the nozzle 24 which are stationary, thus forming a shut-off valve. The reference numeral 28 designates the annular heat-insulation linings of the plates 26 and 27. In this figure, the slide-valve nozzle closure is in the closed position.

FIG. 11 relates to an alternative form of the embodiment shown in FIG. 10. In this example, the stationary upper refractory nozzle 24*a* is provided with a heat-insulation lining 30 which extends to its full height including the orifice of the stationary plate 26. This lining 30 can be formed in a single piece or in a number of sections. The lower refractory sliding nozzle 25*a* is also provided with a heat-insulation lining 29 which extends to its full height including the orifice of the sliding plate 27. The heat-insulation linings 28, 29 and 30 are maintained in position either by means of a refractory cement or by means of internal projections formed at the lower ends of the nozzles 24*a* or 25*a* or of the plates 26 and 27.

FIG. 12 is an enlarged detail view of an alternative design of the immersion nozzle shown in FIGS. 4 and 6. This type of nozzle 15 is more especially employed in the case of casting distributors or transfer vessels fitted with stopper rods, the bottom portion 12 of which can be seen in the figure. This type of nozzle can also be mounted on a slide-valve nozzle closure and constitutes in this case the lower refractory sliding nozzle. Depending on the method adopted for the internal closure of the nozzle 15, the heat-insulation lining 32 can be formed of either one or a number of elements. The lining 32 can also be obtained by immersion or by injection of heat-insulating sludge. In this case the lining 32 is ready for use after the complete assembly has been heated in an oven.

In the example shown in FIG. 12, provision is made for a small cavity 33 which serves to bond the lining 32 to the nozzle 15 by means of any suitable adhesive compound or refractory cement. This cavity can be extended to the full height of the lining 32 so as to maintain the discharge orifice 34 of the lining 32 in the axis of the lateral discharge orifices 36 of the nozzle 15. The lower portion 35 of the nozzle as well as the discharge orifices 36 can also be covered with heat-insulating material.

The improvements in accordance with the embodiments illustrated in FIGS. 10 to 13 are primarily intended to provide the pouring nozzles of refractory material with better heat insulation. The improvements dispense with the need to preheat the nozzle to a temperature in the vicinity of the melting point of the metal to be introduced therein. Furthermore, the lower portion of the nozzle was usually less well heated than the remainder and therefore cooled more rapidly after preheating. As a consequence, drops of metal solidified at the nozzle outlet, thus resulting in deformation or deflection of the jet of metal or even in clogging of the nozzle. It was necessary to unclog this latter by applying a jet of oxygen, which had the serious disadvantage of oxidizing the metal; this oxide had a corrosive action on the nozzle, modified the cross-section of the lower end of this latter and consequently modified the flow rate of the metal to be poured. The removable heat-insulation linings in accordance with the invention provide an effective remedy to all these disadvantages.

We claim:

1. A vessel for transferring liquid metal and having pouring holes, said vessel having lateral walls and a bottom provided with a permanent lining of refractory material, wherein the permanent lining is covered with a removable heat-insulation lining formed of inorganic particles embedded in a binder, said inorganic particles being sinterable at the temperature of the liquid metal which is intended to be introduced into said transfer vessel, and wherein the vessel pouring holes are fitted with a detachable internal lining of insulating material which is also sinterable in contact with the liquid metal, said detachable internal heat-insulating lining being inserted between said removable heat-insulating lining covering the permanent refractory lining provided on the bottom of the vessel and said permanent refractory lining adjacent to the pouring hole.

2. A vessel for transferring liquid metal and having pouring holes, said vessel having lateral walls and a bottom provided with a permanent lining of refractory material, wherein the permanent lining is covered with a removable heat-insulation lining formed of inorganic particles embedded in a binder, said inorganic particles being sinterable at the temperature of the liquid metal which is intended to be introduced into said transfer vessel, and wherein the vessel pouring holes are fitted partly with an internal lining of insulating material which is also sinterable in contact with the liquid metal and partly with a refractory material, at least said lining of insulating material being detachable from said pouring holes, said detachable internal heat-insulating lining being inserted between said removable heat-insulating lining covering the permanent refractory lining provided on the bottom of the vessel and said internal lining of refractory material.

3. A vessel for transferring liquid metal and having pouring holes, said vessel being provided with a permanent lining of refractory material, wherein the permanent lining is covered with a removable heat-insulation lining formed of inorganic particles embedded in a binder, said inorganic particles being sinterable at the temperature of the liquid metal which is intended to be introduced into said transfer vessel, and wherein the vessel pouring holes are fitted with a detachable internal lining of insulating material which is also sinterable in contact with the liquid metal, said transfer vessel comprising at least a pouring hole nozzle of refractory material which is removably engaged in the pouring hole, wherein said lining of insulating material is constituted by a discharge pot of sinterable insulating material, said discharge pot being provided at the upper end thereof with an annular flange which is inserted between the heat-insulation lining and the permanent refractory lining of the vessel and the base of the discharge pot resting on said pouring nozzle of refractory material.

4. A transfer vessel according to claim 3 wherein the internal surface of said pouring nozzle is also covered with a lining of sinterable insulating material.

5. A transfer vessel according to claim 4 wherein the internal lining of sinterable insulating material of said pouring nozzle is secured to the internal surface of said pouring nozzle.

* * * * *